US010016633B2

(12) United States Patent
Perner

(10) Patent No.: US 10,016,633 B2
(45) Date of Patent: Jul. 10, 2018

(54) UTILITY BELT

(71) Applicant: D B Industries, LLC, Red Wing, MN (US)

(72) Inventor: Judd J. Perner, Red Wing, MN (US)

(73) Assignee: D B INDUSTRIES, LLC, Maplewood, MN (US)

( * ) Notice: Subject to any disclaimer, the term of this patent is extended or adjusted under 35 U.S.C. 154(b) by 92 days.

(21) Appl. No.: 14/621,957

(22) Filed: Feb. 13, 2015

(65) Prior Publication Data

US 2015/0231422 A1 Aug. 20, 2015

Related U.S. Application Data

(60) Provisional application No. 61/941,745, filed on Feb. 19, 2014.

(51) Int. Cl.
*A62B 35/00* (2006.01)

(52) U.S. Cl.
CPC ..... *A62B 35/0012* (2013.01); *A62B 35/0037* (2013.01)

(58) Field of Classification Search
CPC ..... A61F 5/028; A62B 35/0018; A62B 35/00; A62B 35/0031; A62B 35/0012; A62B 35/0006; A62B 35/0068; A62B 35/0037; A63B 21/1419; B64D 17/30
USPC ..... 182/3, 5, 6; 224/660, 664; 2/44, 311, 2/312, 321, 322
See application file for complete search history.

(56) References Cited

U.S. PATENT DOCUMENTS 1,971,571 A * 8/1934 McMullen ..... 182/9
2,097,376 A * 10/1937 Marshman ..... A63B 21/0004 182/6
2,254,179 A 8/1941 Hoyt
2,516,004 A * 7/1950 Kajdan ..... B64D 17/30 24/196
2,834,525 A * 5/1958 Shawgo ..... 182/9
3,022,855 A * 2/1962 Lewis ..... 182/3
3,415,340 A * 12/1968 Kinkade ..... A62B 35/0037 182/7
3,448,826 A * 6/1969 Rosenblum ..... A62B 35/0012 182/3
4,103,758 A 8/1978 Himmelrich
4,413,358 A * 11/1983 Jimenez ..... 2/321
5,069,153 A * 12/1991 Pascher ..... 114/39.18
5,179,942 A * 1/1993 Drulias et al. ..... 128/101.1
5,203,754 A * 4/1993 Maclean ..... A63B 21/0004 482/121
5,257,419 A * 11/1993 Alexander ..... 2/44
(Continued)

FOREIGN PATENT DOCUMENTS

EP 2 135 642 A1 12/2009

OTHER PUBLICATIONS

International Patent Application Serial No. PCT/US2015/016380 Search Report dated Jun. 16, 2015.
(Continued)

*Primary Examiner* — Daniel P Cahn

(57) ABSTRACT

A utility belt comprises an upper portion, a lower portion, a connecting member, and first and second connectors. The connecting member operatively connects the upper and lower portions, and the first and second lower connectors are operatively connected to the connecting member. A connector is positioned proximate each side of the user.

9 Claims, 4 Drawing Sheets

(56) References Cited

U.S. PATENT DOCUMENTS 5,329,884 A * 7/1994 Bell ..... 119/857
5,388,274 A * 2/1995 Glover ..... A61F 5/028 128/100.1
5,548,843 A * 8/1996 Chase et al. ..... 2/102
5,776,087 A * 7/1998 Nelson et al. ..... 602/19
6,520,290 B1 * 2/2003 Carter ..... A62B 35/0037 182/3
6,651,594 B1 * 11/2003 Bagwell ..... A47D 13/086 119/770
6,766,532 B1 * 7/2004 Cabana ..... A61F 5/026 2/310
8,333,262 B1 * 12/2012 Carpenter et al. ..... 182/6
2002/0042942 A1 * 4/2002 Colorado ..... A41D 13/0007 2/230
2003/0062218 A1 * 4/2003 Zeissler ..... A62B 35/00 182/3
2004/0138599 A1 * 7/2004 Reinecke et al. ..... 602/36
2005/0205356 A1 * 9/2005 Velasco, Jr. ..... A62B 35/0037 182/3
2006/0137097 A1 * 6/2006 Frost ..... A61F 5/05825 5/628
2007/0084666 A1 * 4/2007 NcLaughlin ..... A62B 1/04 182/3
2009/0011909 A1 * 1/2009 Glisan ..... A63B 21/0552 482/129
2009/0314578 A1 * 12/2009 Hede ..... A62B 35/0012 182/3
2010/0121240 A1 * 5/2010 Smith ..... 602/19
2013/0175117 A1 * 7/2013 Schierenbeck ..... A62B 35/00 182/3

OTHER PUBLICATIONS

4 D-Ring Tool Belt, Bashlin Industries, Inc., Bashlin Climbing Equipment for Line Workers, Feb. 19, 2014, 2 pages.
EZ Rider, Bashlin Industries, Inc., Bashlin Climbing Equipment for Line Workers, Feb. 19, 2014, 2 pages.

* cited by examiner 138a
136a
131a
134b
136b
135b
137b
131b
135
130
126
134a
135a
137a
136a

UTILITY BELT

This application claims the benefit of U.S. Provisional Patent Application Ser. No. 61/941,745 filed Feb. 19, 2014, which is incorporated by reference herein.

BACKGROUND OF THE INVENTION

Utility belts are commonly used with fall protection equipment and used in applications such as, but not limited to, pole climbing, tree climbing, work positioning, and etc. Utility belts currently on the market include four D-rings positioned below the waist, and one problem with such belts is that when the force from positioning is positioned lower down on the user's body, a tendency to tip backward or invert is created, which poses a risk for the user to fall out of the belt. The utility belt of the present invention addresses this problem.

For the reasons stated above and for other reasons stated below, which will become apparent to those skilled in the art upon reading and understanding the present specification, there is a need in the art for an improved utility belt.

BRIEF SUMMARY OF THE INVENTION

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, a utility belt comprises an upper portion, a lower portion, a connecting member, and first and second connectors. The upper portion is configured and arranged to be positioned proximate a user's waist. The lower portion is configured and arranged to be positioned proximate a user's upper thighs. The connecting member operatively connects the upper and lower portions. The first and second lower connectors are operatively connected to the connecting member.

In one embodiment, a utility belt comprises a waist portion, a seat portion, first and second connecting members, and first and second D-rings. The waist portion is configured and arranged to extend about at least a portion of a user's waist. The seat portion is configured and arranged to extend about at least a portion of a user's upper thighs. The first connecting member interconnects the waist portion and the seat portion, and the first D-ring is operatively connected to the first connecting member between the waist portion and the seat portion. The second connecting member interconnects the waist portion and the seat portion, and the second D-ring is operatively connected to the second connecting member between the waist portion and the seat portion. A portion of a load is transferred from the seat portion to the waist portion via the first and second D-rings and the first and second connecting members.

BRIEF DESCRIPTION OF THE DRAWINGS

The present invention can be more easily understood, and further advantages and uses thereof can be more readily apparent, when considered in view of the detailed description and the following Figures in which.

In accordance with common practice, the various described features are not drawn to scale but are drawn to emphasize specific features relevant to the present invention. Reference characters denote like elements throughout the Figures and the text.

DETAILED DESCRIPTION OF THE INVENTION

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

Embodiments of the present invention generally provide a utility belt including four D-rings, two upper D-rings positioned proximate the user's waist and two lower D-rings positioned proximate the user's hips. Although the term "D-ring" is used throughout the description, it is recognized that any suitable type of connector could be used. When the utility belt is loaded, for example should the user fall, the lower D-rings operatively connected to a connecting member create a seat sling effect, which reduces strain on the user's lower back. The utility belt of the present invention reduces the tendency to tip backward or invert because it includes a connecting member interconnecting upper and lower portions of the utility belt and connected to the lower D-rings. An example of this is shown in FIG. 1.

The utility belt could be sold alone and it could be sold connected to a full body harness. If connected to a full body harness, the utility belt is connected to the harness via a connection member, which is preferably made of webbing. The harness webbing is configured into a loop starting at the lumbar area and extending down into the sub pelvic region. During assembly, the utility belt is sewn into the harness so that the harness loop captures the webbing that connects the D-rings of the utility belt. This allows the harness and the utility belt to stay connected during a fall scenario.

Generally, the utility belt includes an upper portion positioned proximate the user's waist and wraps around at least a portion of the user's waist, a middle portion positioned proximate the user's hips and wraps around at least a portion of the user's hips, and a lower portion positioned proximate below the user's hips (proximate the back and sides of a user's upper thighs) and supports the user in a swing-like manner. This is shown in FIG. 1. The upper D-rings are operatively connected to the middle portion, and the lower D-rings are operatively connected to the upper portion and the lower portion. As shown in at least FIG. 2, connecting members interconnect the upper portion and the lower portion to the D-rings.

Figure 1:
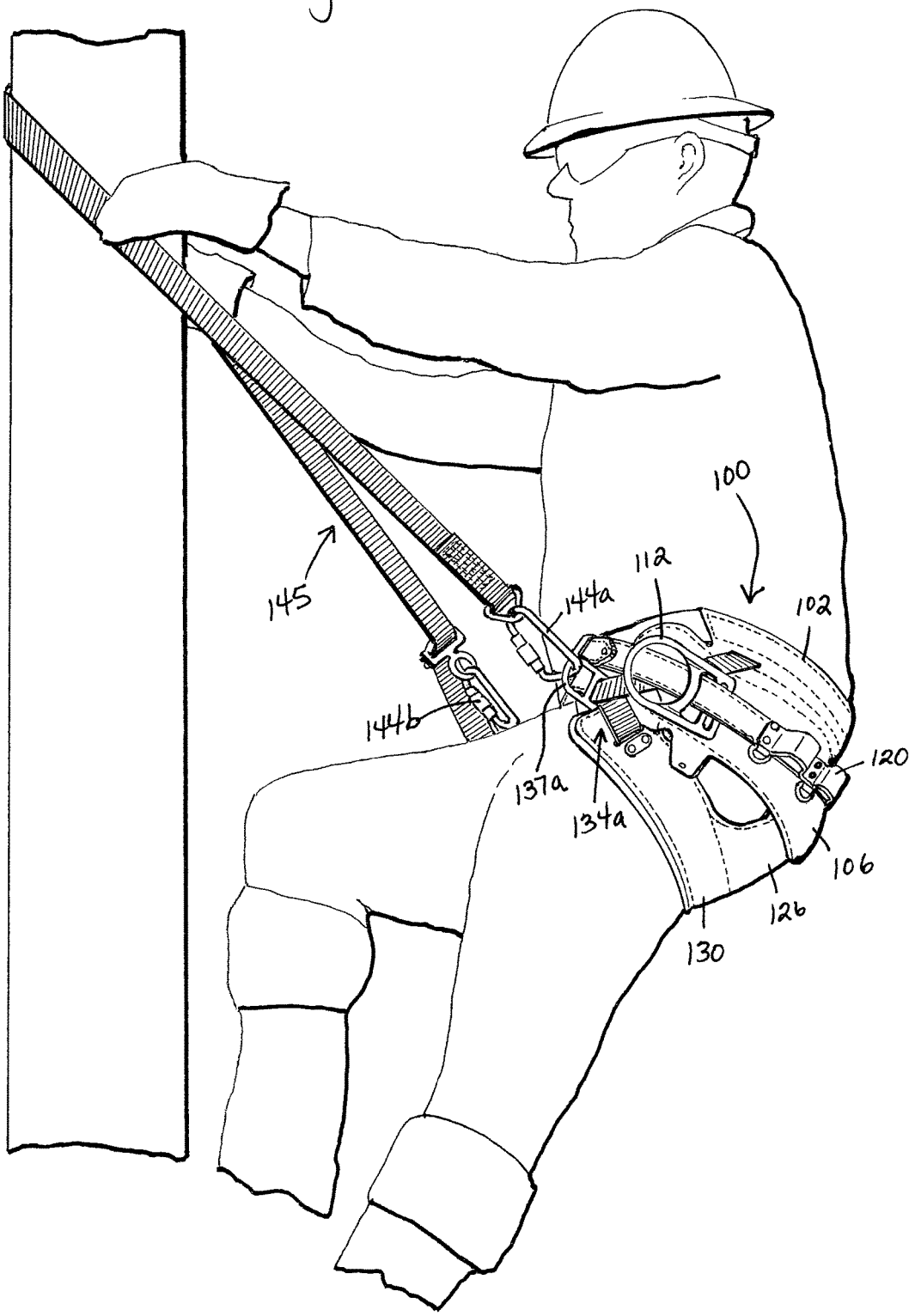
FIG. 1 is a side perspective view of a utility belt constructed in accordance with the principles of the present invention donned by a user and connected to a pole climbing device.

As shown in FIG. 1, the lower portion is preferably curved inward proximate the bottom toward the back of the user's legs for added comfort when in the sitting position. The angle formed by the lower portion relative to the upper portion of the utility belt is preferably approximately 15 to 30 degrees. The connecting member, preferably made of webbing, connecting the upper portion and the lower portion to the lower D-rings is connected in such a manner that when the lower D-rings are loaded, a portion of the load is transferred to the lower portion and the remaining load is transferred to the upper portion to reduce the possibility of tipping or inversion. Although webbing is shown and described, it is recognized that any suitable material could be used for the connecting member. As the load angle changes, so does the load distribution from the lower portion to the upper portion. The connecting member connects the upper and lower portions and is free floating or independent of the middle portion so that the load is transferred between the upper and lower portions.

It is recognized that there are different climbing positions than that shown in FIG. 1. For example, during normal use, the user's fall restrict device could be below, at, or above the user's waist level. When climbing, any of these positions is possible and related to the work position required, and the load will transfer accordingly.

One feature of the present invention is the load transferring ability from proximate the user's seat area to proximate the user's lower back. This not only increases comfort but the upper portion adds an additional point of support, which effectively widens the base of support to balance the user, thereby assisting in preventing tipping backward/inversion. The connection of the lower portion to the upper portion assists in transferring the load and assists in preventing the user from falling out of the utility belt.

The lower D-rings work well in all directions when loaded. The lower D-rings point downward naturally but do not bunch the connecting member when pulled upward. Should a fall occur, some of the load is transferred from the lower portion to the upper portion because they are connected via the connecting member, to which the lower D-rings are connected. When a load is applied to the lower D-rings, the load is applied to the connecting member that connects the upper portion and the lower portion. The connecting member allows some of the load to be transferred between the upper portion and the lower portion. In addition, the connecting member can move independently of the middle portion. This is achieved by passing the connecting member through slots in the middle portion (e.g., hip pad portion) so that it is positioned underneath the middle portion webbing. If the connecting member were connected to the middle portion webbing, it would not transfer the load above the waist and would only share the load between the lower and middle portions. Because the lower and middle portions are so close to each other, the effect would be minimal and would not effectively balance the user or prevent inversion while climbing. Therefore, although the connecting member is routed through slots in the middle portion, the connecting member is not connected to the middle portion in a manner that would restrict the load transfer between the upper and lower portions. This load transfer can be achieved through multiple designs but the concept relies on at least a portion of the load moving from the lower portion to the upper portion depending on the angle the load is applied. If the load is directed downward, the majority of the load is transferred to the upper portion. If the load is directed upward, the majority of the load is transferred to the lower portion. The middle portion serves as an additional connection point for a fall restrict device or positioning lanyard. Typically, a user will climb poles and the like with two devices, a fall restrict device and a positioning lanyard. Because it is not recommended to connect both devices to one set of D-rings, an additional set of D-rings is provided (the lower D-rings). Only one device is used at a time. The fall restrict device is used to climb and the positioning lanyard is used when the fall restrict device needs to be disconnected to move over obstacles.

To assist in comfort, the utility belt could be worn loose on the bottom (the belt proximate the user's hips) and snug at the top (the belt proximate the user's waist). The utility belt is tightened above the user's waist or hip bones thereby keeping it from sliding downward over the user's hips. The utility belt is also exceptional at holding up the weight of extra tools. Alternatively, the upper portion of the connecting portion could be extended in length proximate the front of the utility belt to assist in holding up the utility belt better and envelope the user more secure.

Figures 2, 3A, 3B:
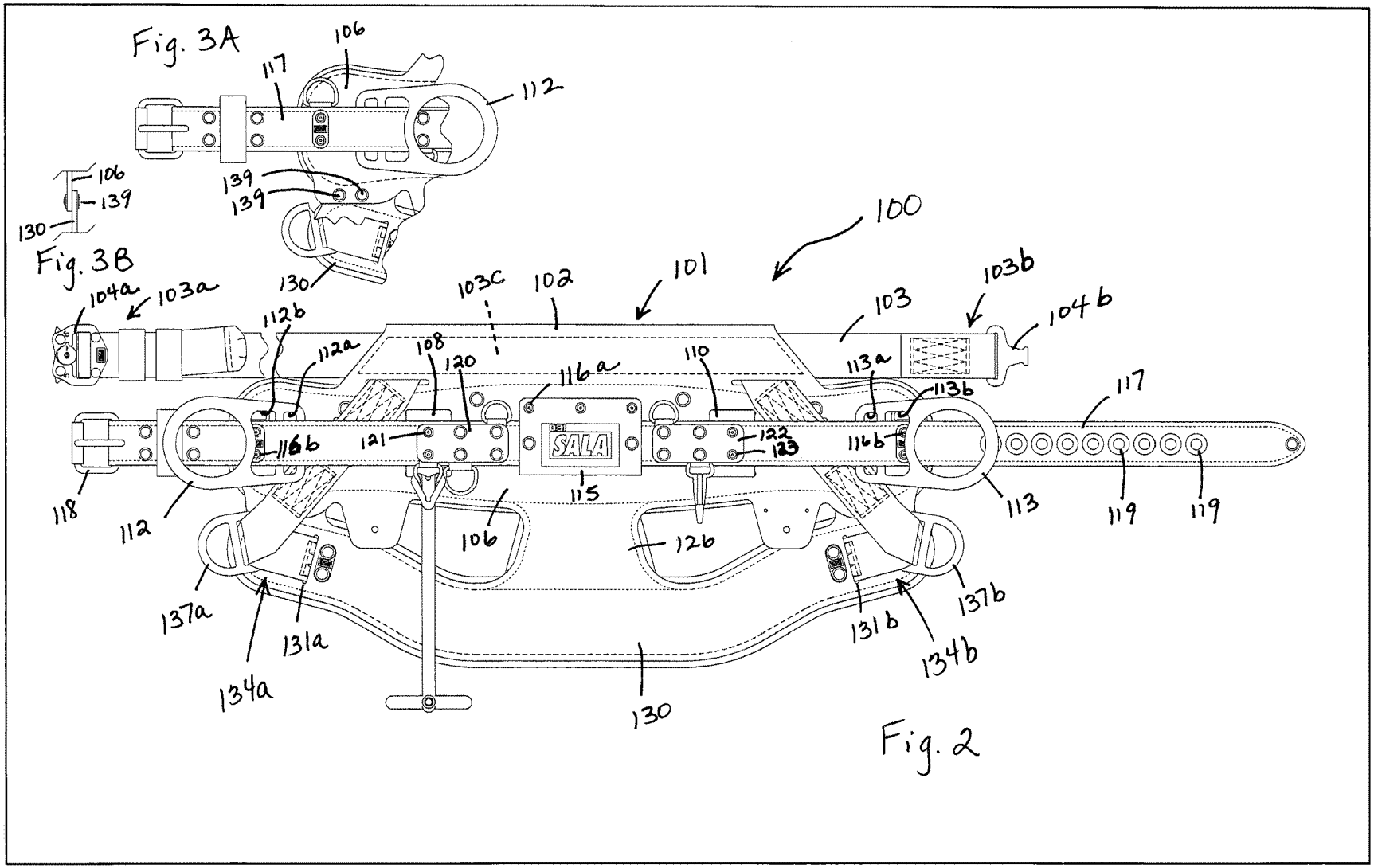
FIG. 2 is a plan view of the utility belt shown in FIG. 1.
FIG. 3A is a portion of the utility belt shown in FIG. 2.
FIG. 3B is a side view of a portion of the utility belt shown in FIG. 3A.

FIGS. 1 and 2 shows an example utility belt 100 constructed in accordance with the principles of the present invention. The utility belt 100 includes a base 101, which includes a waist portion 102, a hip portion 106, a mid-seat portion 126, and a seat portion 130. The base 101 is preferably made of leather and padding.

Figures 4, 5:
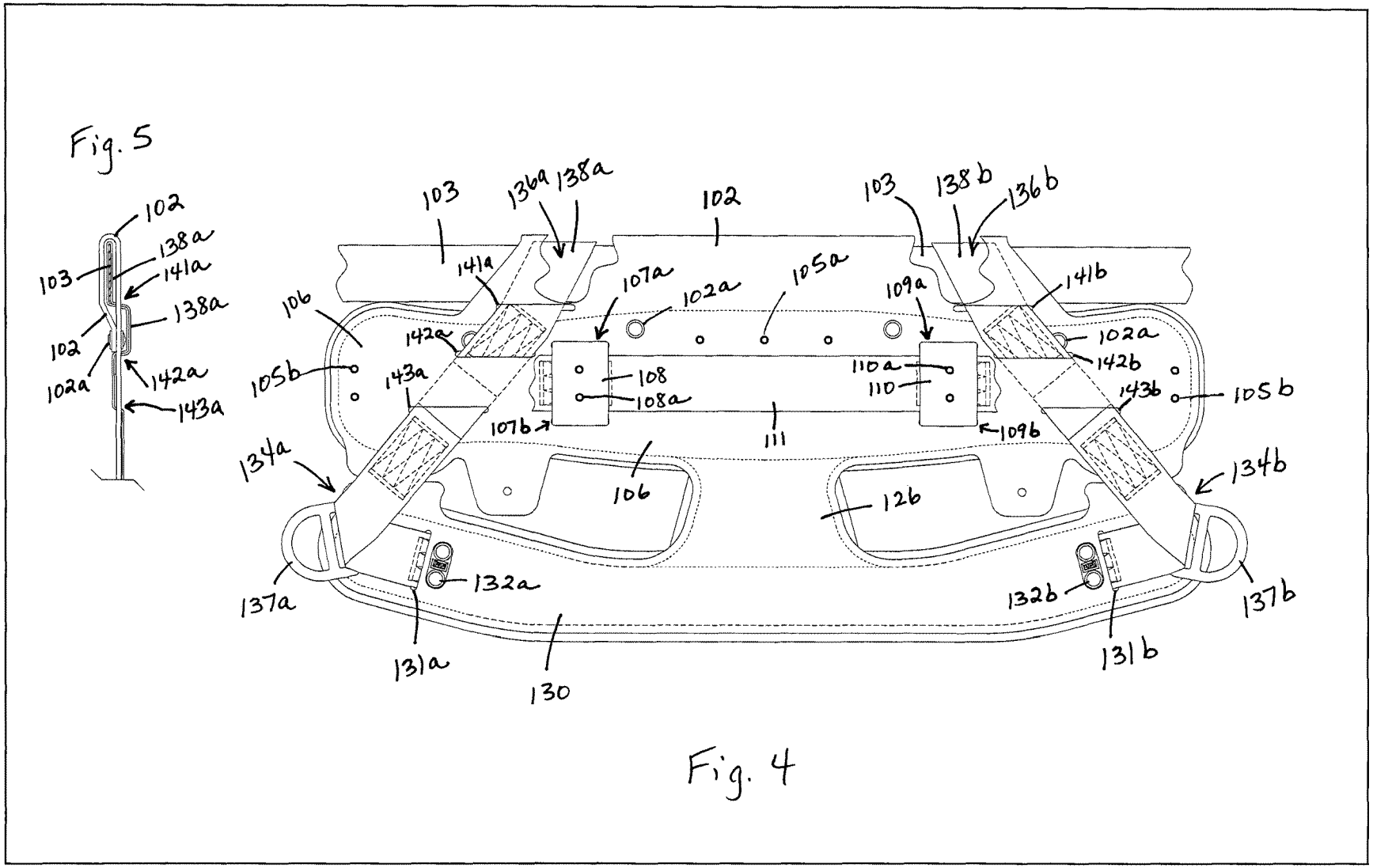
FIG. 4 is a plan view of the utility belt shown in FIG. 2 with some components removed.
FIG. 5 is a side view of a portion of the utility belt shown in FIG. 4.

The waist portion 102 is positioned proximate the user's waist and includes a channel through which a belt 103 extends. As shown in FIG. 5, the waist portion 102 is folded over and then rivets 102*a* connect the edge of the folded over portion to the waist portion 102 to form the channel. Generally, whenever rivets are used, washers may be used on both sides of the component to assist in a more secure connection. Connecting members 134*a* and 134*b* are operatively connected to the belt 103 within the channel, and this is described below in more detail.

The belt 103 includes a first end 103*a*, a second end 103*b*, and an intermediate portion 103*c*. The first end 103*a* is operatively connected to a first buckle portion 104*a*, and the second end 103*b* is operatively connected to a mating second buckle portion 104*b*. The buckle secures the belt 103, which is adjustable, about the user's waist.

The hip portion 106 is positioned below the waist portion 102 and proximate the user's lower back. Proximate the juncture of the waist portion 102 and the hip portion 106 are apertures 105*a* spaced horizontally. Proximate the ends of the hip portion 106 are apertures 105*b*. The hip portion 106 also includes slots 107*a* and 109*a* proximate the top and slots 107*b* and 109*b* proximate the bottom. Slots 107*a* and 107*b* are configured and arranged to receive a loop 108, which includes apertures 108*a*. Slots 109*a* and 109*b* are configured and arranged to receive a loop 110, which includes apertures 110*a*. A connecting strap 111 extends through the loops 108 and 110, and a first end (not shown) is operatively connected to a D-ring 112 and a second end (not shown) is operatively connected to a D-ring 113. The D-ring 112 includes a slot 112*a* through which the connecting strap 111 is inserted and then secured onto itself, and the D-ring 113 includes a slot 113*a* through which the connecting strap 111 is inserted and then secured onto itself. The D-rings 112 and 113 are positioned proximate the sides of the user's hips.

A belt loop 115 is connected to the hip portion 106 between the loops 108 and 110 with rivets 116*a* extending through the apertures 105*a*. A belt 117 extends through the belt loop 115, through a slot 112*b* in the D-ring 112 between a ring portion and the slot 112*a*, and through a slot 113*b* in the D-ring 113 between a ring portion and the slot 113*a*. Rivets 116*b* secure the belt 117 to the hip portion 106 proximate the D-rings 112 and 113 and the distal ends of the hip portion 106. One end of the belt 117 includes a tongue buckle 118, and the other end of the belt 117 includes grommets 119. Straps 120 and 122 are connected to the belt 117 and the loops 108 and 110 with rivets 121 and 123, respectively, and are connected to the belt 117 with rivets. Between the rivets, the straps 120 and 122 form loops extending outward from the belt 117 for attaching tools. In addition, rings and utility clips may be connected to the straps 120 and 122 for attaching tools.

The mid-seat portion 126 extends downward from proximate the middle of the hip portion 106 to interconnect the hip portion 106 and the seat portion 130. The seat portion 130 is configured and arranged to extend around the back and the sides of the user's upper thighs. As shown in FIGS. 3A and 3B, the hip portion 106 and the seat portion 130 are connected with rivets 139. This assists in creating a contoured shape in the seat portion 130. Proximate the distal ends of the seat portion 130 are slots 131*a* and 131*b* through which connecting members 134*a* and 134*b*, respectively, extend. The connecting members 134*a* and 134*b* may be secured to the seat portion 130 with rivets 132*a* and 132*b*, respectively.

Figures 6, 7, 8, 9A, 9B, 10:
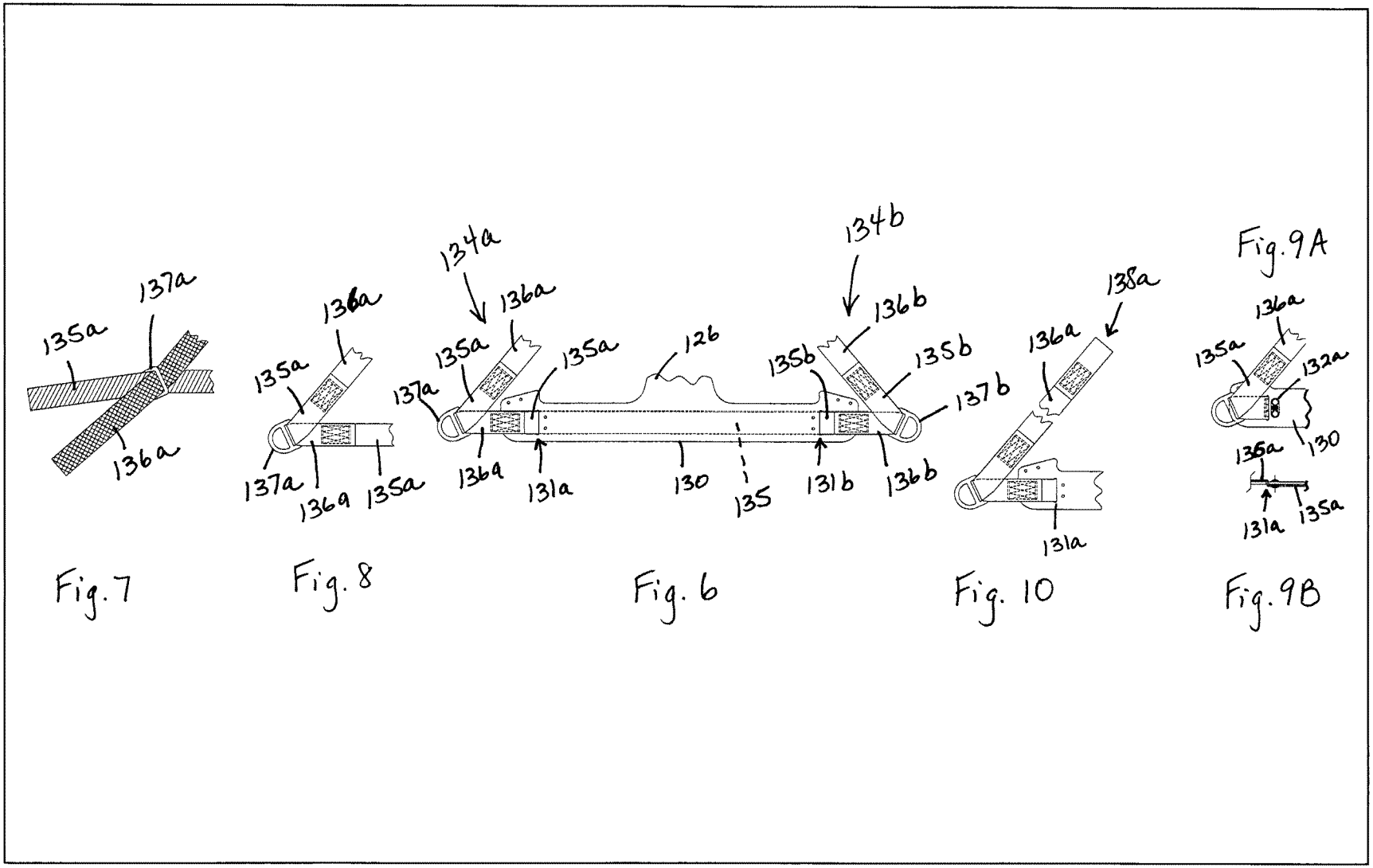
FIG. 6 is a plan view of a strap assembly of the utility belt shown in FIG. 2.
FIG. 7 is a disassembled view of straps of the strap assembly shown in FIG. 6.
FIG. 8 is an assembled view of straps of the strap assembly shown in FIG. 6.
FIG. 9A is an assembled view of straps of the strap assembly shown in FIG. 6 connected to the seat portion of the utility belt.
FIG. 9B is a bottom view of the straps connected to the seat portion shown in FIG. 9A.
FIG. 10 is an assembled view of the strap assembly shown in FIG. 6.

As shown in FIG. 7, the connecting member 134*a* includes two straps, preferably made of webbing. The two straps, strap 135*a* and strap 136*a*, are inserted through a slot in D-ring 137*a*. The distal end of strap 135*a* is connected to the strap 136*a* extending generally vertically, and the distal end of strap 136*a* is connected to the strap 135*a* extending generally horizontally. This is shown in FIG. 8. Similarly, the connecting member 134*b* includes two straps, strap 135*b* and 136*b*, which are inserted through a slot in D-ring 137*b*. The distal end of strap 135*b* is connected to the strap 136*b* extending generally vertically, and the distal end of strap 136*b* is connected to the strap 135*b* extending generally horizontally. In other words, the straps forming each connecting member extend through the slot in the lower D-ring, cross, and then are secured to one another. Although D-rings 137*a* and 137*b* are shown, it is recognized that other suitable lower connectors could be used.

As shown in FIG. 6, the ends of the connecting members 134*a* and 134*b* that extend generally horizontally are the ends extending through the slots 131*a* and 131*b* in the seat portion 130 and then may be secured to the seat portion 130 with rivets 132*a* and 132*b*. The strap 135 connected to the seat portion 130 can rotate independently from the belt 103 connected to the waist portion 102 but only a relatively small amount. The straps 135*a* and 135*b* could be one strap 135 extending through a channel formed in the seat portion 130 as shown in FIG. 6. Alternatively, the straps 135*a* and 135*b* could be separate straps either operatively connected to each other or to the seat portion 130 by any suitable means.

As shown in FIGS. 4 and 5, the distal ends of the straps 136*a* and 136*b* are folded onto themselves and secured to form loops 138*a* and 138*b*, respectively. The loops 138*a* and 138*b* are positioned in the channel formed by the waist portion 102, and the belt 103 extends through the loops 138*a* and 138*b* within the channel. Therefore, the connecting members 134*a* and 134*b* interconnect the belt 103 extending through the waist portion 102 and the strap 135 or the seat portion 130. The waist portion 102 and the seat portion 130 route the connecting members 134*a* and 134*b* proximate the user's sides, with the connecting members 134*a* and 134*b* being positioned more toward the user's sides proximate the waist portion 102 and more toward the user's front proximate the seat portion 130, as shown in FIG. 1.

As shown in FIG. 4, the base 101 includes slots through which the connecting members 134*a* and 134*b* are routed. The slots are positioned so that the connecting members 134*a* and 134 are angled inward as they extend vertically. As described above, connecting member 134*a* is connected to the belt 103 within the channel of the waist portion 102. The connecting member 134*a* extends out of the base 101 through slot 141*a* proximate the bottom of the waist portion 102. The middle of the hip portion 106 includes slots 142*a* and 143*a*. The connecting member 134*a* extends into the base 101 through slot 142*a* and then extends back out of the base 101 through slot 143*a*. The D-ring 137*a* is positioned on the connecting member 134*a* between the slot 143*a* and the slot 131*a* in the seat portion 130, and the D-ring 137*a* may slide along a portion of the connecting member 134*a* between slots 131*a* and 143*a*. Similarly, the connecting member 134*b* is connected to the belt 103 within the channel of the waist portion 102. The connecting member 134*b* extends out of the base 101 through slot 141*b* proximate the bottom of the waist portion 102. The middle of the hip portion 106 includes slots 142*b* and 143*b*. The connecting member 134*b* extends into the base 101 through slot 142*b* and then extends back out of the base 101 through slot 143*b*. The D-ring 137*b* is positioned on the connecting member 134*b* between the slot 143*b* and the slot 13 lb in the seat portion 130, and the D-ring 137*b* may slide along a portion of the connecting member 134*b* between slots 131*b* and 143*b*.

As shown in FIG. 1, for one application with which the present invention could be used, carabiners 144*a* and 144*b* may be connected to the D-rings 137*a* and 137*b* for connecting to a pole climbing device 145. The pole climbing device 145 is shown generally as webbing straps. An example of a suitable pole climbing device is the CYNCH-LOK™ pole climbing device, either web or rope, by D B Industries, LLC d/b/a Capital Safety USA of Red Wing, Minnesota. It is recognized that other suitable types of pole climbing devices could be used, and the present invention could be used for other types of applications, not just pole climbing.

In use, should a fall occur, if the load is directed downward, the majority of the load is transferred to the upper portion or the belt 103 proximate the waist portion 102. If the load is directed upward, the majority of the load is transferred to the lower portion or the strap 135 proximate the seat portion 130.

The above specification, examples, and data provide a complete description of the manufacture and use of the composition of embodiments of the invention. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the invention. Therefore, it is manifestly intended that this invention be limited only by the claims and the equivalents thereof.

The invention claimed is:

1. A utility belt, comprising:

an upper portion configured and arranged to be positioned proximate a user's waist;

a lower portion configured and arranged to be positioned proximate a user's upper thighs;

a connecting member directly connecting the upper and lower portions; and first and second lower connectors slidably connected to the connecting member and slidable along the connecting member between the upper portion and the lower portion, the first and second lower connectors configured and arranged to be positioned proximate each side of a user, the first and second lower connectors and the connecting member being configured and arranged to transfer a portion of a load between the lower portion and the upper portion during use, wherein the first and second lower connectors are moveable along the connecting member toward the upper portion when the utility belt is subjected to a downward load that transfers a portion of the downward load to the upper portion, and wherein the first and second lower connectors are moveable along the connecting member toward the lower portion when the utility belt is subjected to an upward load that transfers a portion of the upward load to the lower portion.

2. The utility belt of claim 1, wherein the upper portion includes a waist belt configured and arranged to wrap around a portion of a user's waist, and wherein the lower portion is configured and arranged to be positioned proximate backs and sides of a user's upper thighs.

3. The utility belt of claim 1, further comprising a connecting portion operatively connecting the upper and lower portions proximate intermediate portions of the upper and lower portions.

4. The utility belt of claim 1, further comprising a middle portion positioned between the upper and lower portions, the middle portion being configured and arranged to be positioned proximate a user's hips.

5. The utility belt of claim 4, further comprising a connecting portion operatively connecting the middle portion to the upper and lower portions.

6. The utility belt of claim 4, further comprising first and second upper connectors operatively connected to the middle portion.

7. The utility belt of claim 6, further comprising a hip belt extending through slots in the first and second upper connectors and configured and arranged to wrap around a user's hips.

8. The utility belt of claim 1, wherein the upper portion includes a waist belt with a buckle.

9. The utility belt of claim 1, wherein the connecting member includes two straps.

* * * * *